US010220612B2

(12) United States Patent
Izuo

(10) Patent No.: US 10,220,612 B2
(45) Date of Patent: Mar. 5, 2019

(54) DRIVE SIGNAL ADJUSTMENT METHOD OF LIQUID EJECTING HEAD AND LIQUID EJECTING APPARATUS

(71) Applicant: SEIKO EPSON CORPORATION, Tokyo (JP)

(72) Inventor: Seiji Izuo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/645,051

(22) Filed: Jul. 10, 2017

(65) Prior Publication Data

US 2018/0022089 A1 Jan. 25, 2018

(30) Foreign Application Priority Data

Jul. 20, 2016 (JP) ..... 2016-142814

(51) Int. Cl.
*B41J 2/045* (2006.01)
*B41J 29/38* (2006.01)

(52) U.S. Cl.
CPC ..... *B41J 2/04541* (2013.01); *B41J 2/04581* (2013.01); *B41J 2/04586* (2013.01); *B41J 2/04588* (2013.01); *B41J 29/38* (2013.01)

(58) Field of Classification Search
CPC ..... B41J 2/04581; B41J 2/04588; B41J 2/04541; B41J 29/38; B41J 2/14233; B41J 2/04591; B41J 2/04573; B41J 2/04586; B41J 29/393
USPC ..... 347/9, 10, 1, 14, 16, 681, 11, 19, 68
See application file for complete search history.

(56) References Cited

FOREIGN PATENT DOCUMENTS

JP 2001-162781 A 6/2001
JP 2010-094875 A 4/2010

*Primary Examiner* — Jannelle M Lebron
(74) *Attorney, Agent, or Firm* — Workman Nydegger

(57) ABSTRACT

A drive signal adjustment method adjusts a drive signal including a drive pulse to be supplied to a drive element of a liquid ejecting head. The liquid ejecting head includes a nozzle, a pressure generation chamber communicating with the nozzle, and the drive element generating a pressure change in a liquid inside the pressure generation chamber. The drive pulse includes an expansion element, an expansion maintenance element, a contraction element, a contraction maintenance element, and an expansion restoration element. A plurality of test patterns are printed by using adjusting drive pulses including modification values in which either one or both of a time of the contraction maintenance element and a period of the drive pulse are modified. The adjusting drive pulse corresponding to a specific test pattern selected from among the plurality of test patterns set as the drive pulse at the time of printing.

9 Claims, 22 Drawing Sheets

FIG. 10

STANDARD INK (C)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 11

STANDARD INK (Y)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 12

STANDARD INK (M)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 13

STANDARD INK (B)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 14

STANDARD INK (COMBINED)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 15

COMPANY A PRODUCT INK A1 (C)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 16

COMPANY A PRODUCT INK A1 (Y)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 17

COMPANY A PRODUCT INK A1 (M)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 18

COMPANY A PRODUCT INK A1 (B)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 19

COMPANY A PRODUCT INK A1 (COMBINED)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 20

COMPANY B PRODUCT INK B1 (C)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 21

COMPANY B PRODUCT INK B1 (Y)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 22

COMPANY B PRODUCT INK B1 (M)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 23

COMPANY B PRODUCT INK B1 (B)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 24

COMPANY B PRODUCT INK B1 (COMBINED)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 25

COMPANY C PRODUCT INK C1 (C)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 26

COMPANY C PRODUCT INK C1 (Y)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 27

COMPANY C PRODUCT INK C1 (M)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 28

COMPANY C PRODUCT INK C1 (B)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

FIG. 29

COMPANY C PRODUCT INK C1 (COMBINED)

| | | | | | | |
|---|---|---|---|---|---|---|
| (−3,−3) | (−2,−3) | (−1,−3) | (0,−3) | (1,−3) | (2,−3) | (3,−3) |
| (−3,−2) | (−2,−2) | (−1,−2) | (0,−2) | (1,−2) | (2,−2) | (3,−2) |
| (−3,−1) | (−2,−1) | (−1,−1) | (0,−1) | (1,−1) | (2,−1) | (3,−1) |
| (−3,0) | (−2,0) | (−1,0) | (0,0) | (1,0) | (2,0) | (3,0) |
| (−3,1) | (−2,1) | (−1,1) | (0,1) | (1,1) | (2,1) | (3,1) |
| (−3,2) | (−2,2) | (−1,2) | (0,2) | (1,2) | (2,2) | (3,2) |
| (−3,3) | (−2,3) | (−1,3) | (0,3) | (1,3) | (2,3) | (3,3) |

| | t | T |
|---|---|---|
| STANDARD INK | ±0 | ±0 |
| COMPANY A PRODUCT INK A1 | +2 | ±0 |
| COMPANY B PRODUCT INK B1 | ±0 | −3 |
| COMPANY C PRODUCT INK C1 | +1 | +1 |

DRIVE SIGNAL ADJUSTMENT METHOD OF LIQUID EJECTING HEAD AND LIQUID EJECTING APPARATUS

BACKGROUND

1. Technical Field

The present invention relates to a drive signal adjustment method which adjusts a drive signal of a liquid ejecting head which ejects droplets from a nozzle, and to a liquid ejecting apparatus. In particular, the invention relates to a drive signal adjustment method of an ink jet recording head which ejects an ink as a liquid, and to an ink jet recording apparatus.

2. Related Art

For example, as a liquid ejecting apparatus, there is known an ink jet recording apparatus which ejects ink droplets as a liquid to perform printing on an ejection medium such as paper or a recording sheet.

An ink jet recording head which is installed in an ink jet recording apparatus is provided with a piezoelectric actuator on one surface side of a flow path forming substrate having a pressure generation chamber, which communicates with a nozzle, formed therein, and by driving the piezoelectric actuator using a drive signal, the ink in the pressure generation chamber is caused to have a pressure change, and ink droplets are discharged from the nozzle.

The drive signal which is applied to a drive element which is typified by the piezoelectric actuator is set to be optimum based on components such as the structure of the ink jet recording head, the viscosity and the surface tension of the ink, and the like.

However, even if the drive signal is optimized, problems such as streaks may occur in the printed result due to environmental changes or the like. Therefore, there is proposed a method of printing a test pattern to correct the drive signal (for example, refer to JP-A-2001-162781 and JP-A-2010-94875).

However, there is a problem in that it is difficult to directly set the waveform elements of the drive signal each time the test pattern is printed, which takes time and is complicated until a stable printed result is obtained.

There is also a problem in that, since the drive signal is optimized for a standard ink, due to modification of other inks than the standard ink in addition to environmental changes which may be anticipated, it may not be possible to stably discharge another ink using the drive signal which is optimized for the standard ink or the range over which the drive signal is to be corrected is expanded according to types of ink, and thus, it is difficult to correct the drive signal merely by directly setting the waveform elements of the drive signal.

There is further a problem in that, since there are a large number of ink manufacturers and types of ink, it is not practically possible to prepare drive signals for every type of ink in advance, and it is difficult to set an optimum drive signal corresponding to other inks besides the standard ink.

These problems exist not only in the drive signal adjustment method of the ink jet recording head, but also in the drive signal adjustment method of a liquid ejecting head which ejects a liquid other than an ink.

SUMMARY

An advantage of some aspects of the invention is to provide a drive signal adjustment method of a liquid ejecting head and a liquid ejecting apparatus which are capable of easily adjusting a drive signal to correspond to a liquid.

According to an aspect of the invention, there is provided a drive signal adjustment method of a liquid ejecting head in which the drive signal adjustment method adjusts a drive signal which includes a drive pulse to be supplied to a drive element of the liquid ejecting head which includes a nozzle, a pressure generation chamber which communicates with the nozzle, and the drive element which generates a pressure change in a liquid inside the pressure generation chamber, in which the drive pulse includes an expansion element which expands a volume of the pressure generation chamber from a reference volume, an expansion maintenance element which maintains the volume of the pressure generation chamber which is expanded by the expansion element, a contraction element which contracts the volume of the pressure generation chamber, a contraction maintenance element which maintains the volume of the pressure generation chamber which is contracted by the contraction element, and an expansion restoration element which restores the volume of the pressure generation chamber to the reference volume, in which a plurality of test patterns which are image data are output using a drive pulse which includes modification values in which either one or both of a time of the contraction maintenance element and a period of the drive pulse are modified, and in which the modification values are set due to a specific test pattern being selected from among the plurality of test patterns.

In this aspect, it is possible to easily select a specific test pattern by comparing a plurality of test patterns by outputting a plurality of test patterns. Since it is possible to set either one or both of the time and the period of the expansion maintenance element by selecting the specific test pattern, it is possible to easily set an optimum drive signal in a short time as compared with directly setting either one or both of the time and the period of the expansion maintenance element.

Here, it is preferable that the plurality of test patterns which include the modification values in which at least a time of the contraction element is modified be output, and a time of the contraction maintenance element be modified based on a modification amount and a range to modify which are selected on a presentation unit which displays, in a selectable manner, a selection screen for selecting the modification amount and the range to modify of the time of the contraction maintenance element. Accordingly, by rendering the modification amount and the range to modify selectable, it is possible to reliably set the optimum drive signal in a short time.

It is preferable that the plurality of test patterns be disposed in a matrix formation and output onto a medium using a drive pulse which includes the modification values in which both the time and the period of the contraction maintenance element are modified. Accordingly, it is possible to easily select a specific test pattern by comparing a plurality of test patterns by outputting a plurality of test patterns. By disposing and outputting the plurality of test patterns in matrix formation, it is possible to easily compare the plurality of test patterns to each other.

It is preferable that the plurality of test patterns in which the times of the contraction maintenance elements are different be provided to line up in a movement direction with respect to the medium of the liquid ejecting head, and the plurality of test patterns which have different periods be provided to line up in a direction which is orthogonal to the movement direction which is a transport direction of the medium. Accordingly, by providing the test patterns in which the time of the contraction maintenance element is different to line up in the movement direction, in comparison to a configuration in which the test patterns which have a modified period are provided to line up in the movement direction of the liquid ejecting head, it is possible to shorten the output time of the plurality of test patterns, and it is possible to suppress landing position shifting of droplets onto the medium in each of the outgoing path and the return path of the movement direction.

It is preferable that after a specific one of the test patterns is selected, a modification amount and a range to modify of the modification value of the drive pulse be further specified and a plurality of test patterns be output. Accordingly, it is possible to easily set a further optimized drive signal in a short time.

It is preferable that the modification value which is previously set be stored, and the modification value may be restored. Accordingly, it is possible to restore arbitrary modification values when incorrect settings are performed or the like.

It is preferable that by selecting the liquid, the modification value, in which either one or both of a time and a period of a contraction maintenance element of the drive pulse which is associated with the liquid is set in advance, be acquired, a value be modified from the modification value which is acquired, and a plurality of test patterns be output. Accordingly, it is possible to easily set the optimum drive signal of a specific liquid in a short time.

It is preferable that when it is detected that the liquid is exchanged or added to, the plurality of test patterns be output to allow a specific test pattern to be selected. Accordingly, even in a case in which exchanging or adding of the liquid is performed, it is possible to set the optimum drive signal.

According to another aspect of the invention, there is provided a liquid ejecting apparatus which includes a nozzle which ejects a liquid, a pressure generation chamber which communicates with the nozzle, and a drive element which generates a pressure change in a liquid inside the pressure generation chamber due to a drive signal being applied, a drive signal generation unit which generates, as the drive signal, a drive signal which includes a drive pulse which includes an expansion element which expands a volume of the pressure generation chamber from a reference volume, an expansion maintenance element which maintains the volume of the pressure generation chamber which is expanded by the expansion element, a contraction element which contracts the volume of the pressure generation chamber, a contraction maintenance element which maintains the volume of the pressure generation chamber which is contracted by the contraction element, and an expansion restoration element which restores the volume of the pressure generation chamber to the reference volume, a control unit which controls the drive signal generation unit to generate a reference drive pulse which is the drive pulse which is generated using reference values in which a time of the contraction maintenance element and a period of the drive pulse are references, and a adjusting drive pulse which is the drive pulse which is generated using modification values in which the time and the period of the contraction maintenance element are different from the reference values, and drives the drive element using each of the reference drive pulse and the adjusting drive pulse which are generated to output a plurality of test patterns, and a presentation unit which presents a specific test pattern from the plurality of test patterns in a selectable manner, in which the control unit sets the modification values which are used for the output of the specific test pattern based on the specific test pattern which is selected on the presentation unit.

In this aspect, by comparing the plurality of test patterns which are output and the user selecting a specific test pattern based on the presentation unit, it is possible to easily set either one or both of the time and the period of the optimum contraction maintenance element in a short time. Since it is sufficient to only compare the plurality of test patterns which are output, it is possible to easily set either one or both of the time and the period of the contraction maintenance element in a short time as compared with the user directly setting either one or both of the time and the period of the contraction maintenance element.

BRIEF DESCRIPTION OF THE DRAWINGS

The invention will be described with reference to the accompanying drawings, wherein like numbers reference like elements.

FIG. 10 is a diagram illustrating the test pattern of a standard ink according to the first embodiment.

FIG. 11 is a diagram illustrating the test pattern of a standard ink according to the first embodiment.

FIG. 12 is a diagram illustrating the test pattern of a standard ink according to the first embodiment.

FIG. 13 is a diagram illustrating the test pattern of a standard ink according to the first embodiment.

FIG. 14 is a diagram in which the results of the standard inks according to the first embodiment are combined.

FIG. 15 is a diagram illustrating the test pattern of company A product inks according to the first embodiment.

FIG. 16 is a diagram illustrating the test pattern of company A product inks according to the first embodiment.

FIG. 17 is a diagram illustrating the test pattern of company A product inks according to the first embodiment.

FIG. 18 is a diagram illustrating the test pattern of company A product inks according to the first embodiment.

FIG. 19 is a diagram in which the results of the company A product inks according to the first embodiment are combined.

FIG. 20 is a diagram illustrating the test pattern of company B product inks according to the first embodiment.

FIG. 21 is a diagram illustrating the test pattern of company B product inks according to the first embodiment.

FIG. 22 is a diagram illustrating the test pattern of company B product inks according to the first embodiment.

FIG. 23 is a diagram illustrating the test pattern of company B product inks according to the first embodiment.

FIG. 24 is a diagram in which the results of the company B product inks according to the first embodiment are combined.

FIG. 25 is a diagram illustrating the test pattern of company C product inks according to the first embodiment.

FIG. 26 is a diagram illustrating the test pattern of company C product inks according to the first embodiment.

FIG. 27 is a diagram illustrating the test pattern of company C product inks according to the first embodiment.

FIG. 28 is a diagram illustrating the test pattern of company C product inks according to the first embodiment.

FIG. 29 is a diagram in which the results of the company C product inks according to the first embodiment are combined.

DESCRIPTION OF EXEMPLARY EMBODIMENTS

Hereinafter, detailed description of the embodiments of the invention will be given.

First Embodiment

Figure 1:
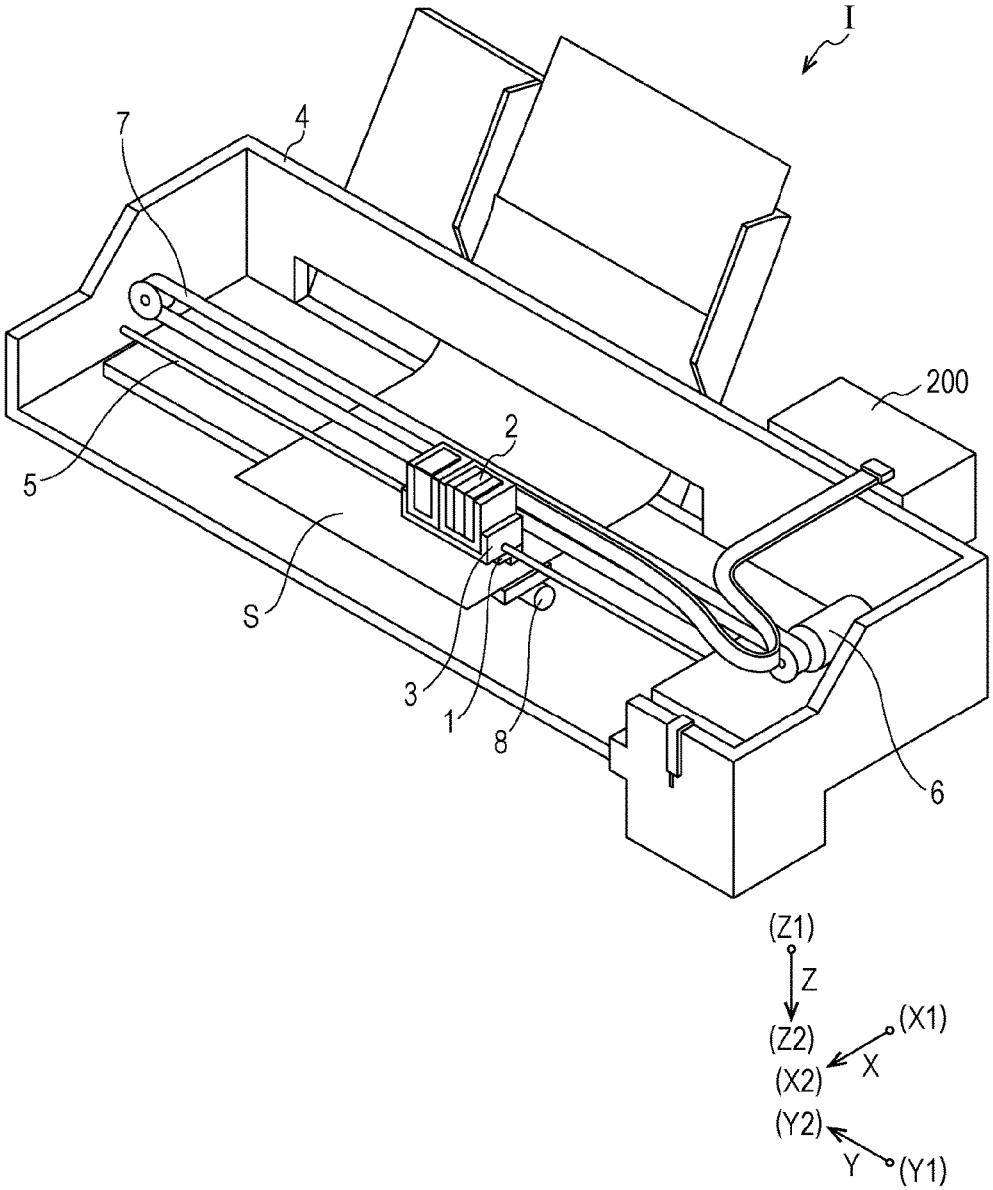
FIG. 1 is a schematic perspective diagram of a recording apparatus according to a first embodiment.

FIG. 1 is a perspective diagram illustrating the schematic configuration of an ink jet recording apparatus which is an example of a liquid ejecting apparatus according to the first embodiment of the invention.

As illustrated in FIG. 1, an ink jet recording apparatus I which is an example of the liquid ejecting apparatus of the present embodiment is provided with an ink jet recording head 1 (hereinafter also referred to simply as a recording head 1) which ejects an ink which serves as the liquid as ink droplets. The recording head 1 is installed on a carriage 3, and the carriage 3 is provided to be capable of moving in the axial direction of a carriage shaft 5 along the carriage shaft 5 which is attached to an apparatus main body 4. An ink cartridge 2 which configures a liquid supply unit is detachably provided on the carriage 3. In the present embodiment, four of the recording heads 1 are installed in the carriage 3, and different inks, for example, cyan (C), magenta (M), yellow (Y) and black (K) inks are ejected from the four recording heads 1. In other words, a total of four of the ink cartridges 2 which hold different inks are mounted in the carriage 3.

The carriage 3 on which the recording head 1 is installed is moved reciprocally along the carriage shaft 5 due to the drive force of a drive motor 6 being transmitted to the carriage 3 via a plurality of gears (not illustrated) and a timing belt 7. Meanwhile, a transport roller 8 which serves as a transport unit is provided in the apparatus main body 4, and a recording sheet S which is the ejection medium such as paper onto which the ink lands is transported by the transport roller 8. The transport unit which transports the recording sheet S is not limited to a transport roller and may be a belt, a drum, or the like. In the present embodiment, the transport direction of the recording sheet S is referred to as a first direction X, the upstream side of the recording sheet S in the transport direction is referred to as X1, and the downstream side is referred to as X2. The movement direction of the carriage 3 along the carriage shaft 5 is referred to as a second direction Y, a one end portion side of the carriage shaft 5 is referred to as Y1, and the other end portion side is referred to as Y2. Incidentally, the carriage 3 has a home position on the Y1 side, which is the one end portion side of the carriage shaft 5. Although not specifically shown, a cleaning unit which cleans a liquid ejecting surface from which the ink droplets of the recording head 1 are ejected is provided on the Y1 side of the carriage 3. Examples of the cleaning unit include a suction unit which sucks the ink from nozzles of the recording head 1, and a wiping unit which wipes the liquid ejecting surface with a wiper blade.

In the present embodiment, the direction intersecting both the first direction X and the second direction Y is referred to as a third direction Z, the recording head 1 side with respect to the recording sheet S is referred to as Z1, and the recording sheet S side is with respect to the recording head 1 is referred to as Z2. In the present embodiment, the relationship between the directions (X, Y, and Z) is orthogonal; however, the dispositional relationship of the components is not necessarily limited to being orthogonal.

In the ink jet recording apparatus I, printing is executed across substantially the entire surface of the recording sheet S by ejecting ink droplets from the recording head 1 while the recording sheet S is transported in the first direction X relative to the recording head 1, and the carriage 3 is caused to move reciprocally in the second direction Y relative to the recording sheet S.

Figure 2:
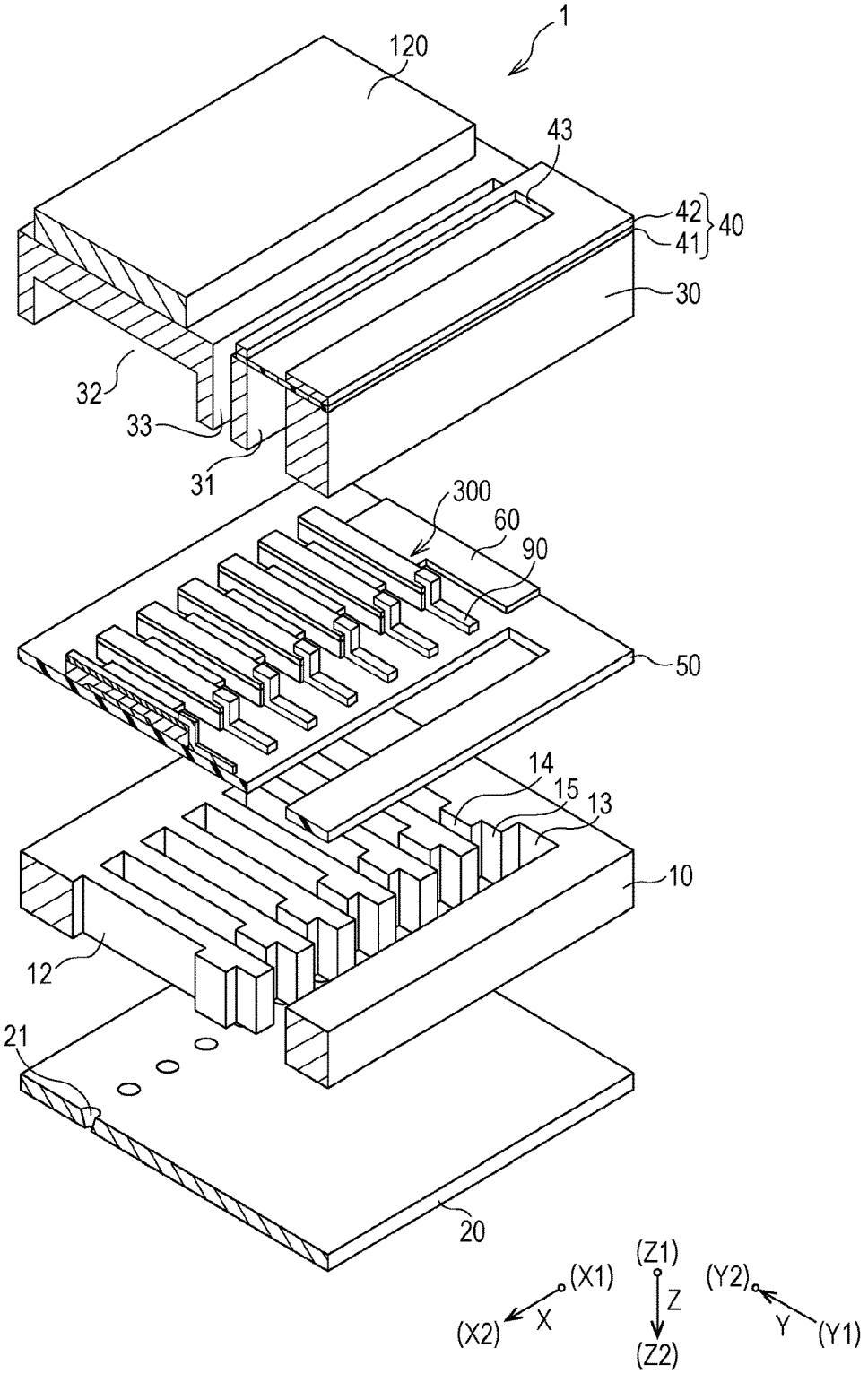
FIG. 2 is an exploded perspective diagram of a recording head according to the first embodiment.
Figure 3:
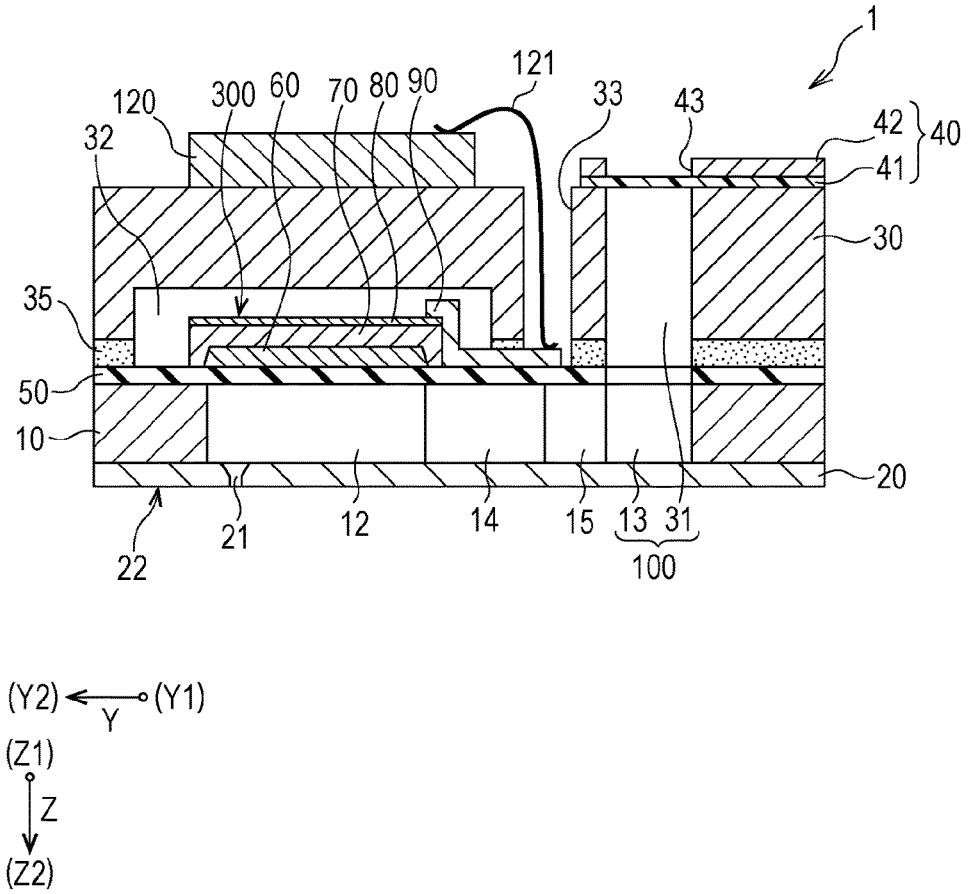
FIG. 3 is a sectional diagram of the recording head according to the first embodiment.

Here, description will be given of an example of a recording head which is installed on such an ink jet recording apparatus with reference to FIGS. 2 and 3. FIG. 2 is an exploded perspective diagram of an ink jet recording head, which is an example of the liquid ejecting head according to the first embodiment of the invention, and FIG. 3 is a sectional diagram of the recording head taken along the second direction. In the present embodiment, description will be given regarding the directions of the recording head based on the directions when the recording head is installed on the ink jet recording apparatus I, that is, based on the first direction X, the second direction Y, and the third direction Z. Naturally, the disposition of the recording head 1 inside the ink jet recording apparatus I is not limited to that indicated hereinafter.

As illustrated in FIGS. 2 and 3, a flow path forming substrate 10 which configures the recording head 1 of the present embodiment is formed from a silicon single crystal substrate, and a vibration plate 50 is formed on one surface thereof. The vibration plate 50 may be a single layer or a laminate which is selected from a silicon dioxide layer and a zirconium oxide layer.

A plurality of pressure generation chambers 12 are provided to line up along the first direction X in the flow path forming substrate 10. A communicating portion 13 is formed in a region outside of the pressure generation chambers 12 of the flow path forming substrate 10 in the second direction Y, and the communicating portion 13 and each of the pressure generation chambers 12 are communicated with each other via an ink supply path 14 and a communicating path 15 provided for each of the pressure generation chambers 12. The communicating portion 13 is communicated with a manifold portion 31 of a protective substrate (described later) so as to configure a portion of a manifold 100 which serves as a common ink chamber to the pressure generation chambers 12. The ink supply path 14 is formed to be narrower in width than the pressure generation chamber 12, and maintains a fixed resistance at the flow path to ink flowing into the pressure generation chamber 12 from the communicating portion 13.

A nozzle plate 20 is fixed to the surface of the Z2 side in the third direction Z of the flow path forming substrate 10 using an adhesive, a thermal-welding film, or the like. Nozzles 21, each of which communicates with the vicinity of the end portion of the opposite side from the ink supply path 14 of each of the pressure generation chambers 12, are drilled openings in the nozzle plate 20. The nozzle plate 20 is formed of, for example, a glass ceramic, a silicon single crystal substrate, stainless steel, or the like. The surface on the Z2 side of the nozzle plate 20 where the nozzles 21 are opened serves as a liquid ejecting surface 22 of the present embodiment.

Meanwhile, the vibration plate 50 is formed on the surface of the Z1 side of the flow path forming substrate 10, and a first electrode 60, a piezoelectric body layer 70, and a second electrode 80 are laminated onto the vibration plate 50 using film forming or a lithography method to configure a piezoelectric actuator 300. In the present embodiment, the piezoelectric actuator 300 forms a drive element which causes a pressure change to arise in the ink inside the pressure generation chamber 12. Here, the piezoelectric actuator 300 is also referred to as the piezoelectric element 300, and the piezoelectric actuator 300 indicates portions including the first electrode 60, the piezoelectric body layer 70, and the second electrode 80. Generally, one of the electrodes in the piezoelectric actuator 300 is a common electrode, and the other electrode and the piezoelectric body layer 70 are patterned for each of the pressure generation chambers 12. In the present embodiment, although the first electrode 60 is used as the common electrode of the piezoelectric actuator 300, and the second electrode 80 is used as the individual electrode of the piezoelectric actuator 300, the pair may be reversed according to the circumstances of the drive circuit or the wiring. In the example which is described above, the vibration plate 50 and the first electrode 60 are used as the vibration plate, but there are naturally not limited hereto, and, for example, a configuration may be adopted in which the vibration plate 50 is not provided, and only the first electrode 60 acts as the vibration plate. The piezoelectric actuator 300 itself may essentially also function as a vibration plate.

A lead electrode 90 is connected to the respective second electrode 80 of each of the piezoelectric actuators 300, and a voltage is selectively applied to each of the piezoelectric actuators 300 via the lead electrodes 90.

A protective substrate 30 is bonded, via adhesive 35, to the surface of the piezoelectric actuator 300 side of the flow path forming substrate 10. The protective substrate 30 includes the manifold portion 31 which configures at least a portion of the manifold 100. In the present embodiment, the manifold portion 31 penetrates the protective substrate 30 in the third direction Z, is formed along the width direction of the pressure generation chamber 12, and communicates with the communicating portion 13 of the flow path forming substrate 10 as described above to form the manifold 100 which serves as the common ink chamber of each of the pressure generation chambers 12.

A piezoelectric actuator holding portion 32 having a space of a magnitude that does not impede the motion of the piezoelectric actuator 300 is provided in a region in the protective substrate 30 which faces the piezoelectric actuator 300. The piezoelectric actuator holding portion 32 may have a space of a magnitude that does not impede the motion of the piezoelectric actuator 300, and the space may be sealed or not sealed.

It is preferable to use materials having substantially the same coefficient of thermal expansion as the flow path forming substrate 10, for example, glass, ceramics, and other materials for the protective substrate 30, in the present embodiment, the protective substrate 30 is formed using a silicon single crystal substrate made of the same material as the flow path forming substrate 10.

A through hole 33 which penetrates the protective substrate 30 in the third direction Z is provided in the protective substrate 30. The vicinity of the end portion of the lead electrode 90 which is lead out from each of the piezoelectric actuators 300 is provided to be exposed to the inside of the through hole 33.

A drive circuit 120 for driving the piezoelectric actuators 300 is provided on the surface of the Z1 side of the protective substrate 30. For example, it is possible to use a circuit substrate, a semiconductor integrated circuit (IC), or the like for the drive circuit 120. The drive circuit 120 and the lead electrodes 90 are electrically connected via connecting wires 121 which are formed of conductive wires such as bonding wires.

A compliance substrate 40 which is formed of a sealing film 41 and a fixing plate 42 is bonded to the surface of the Z1 side of the protective substrate 30. Here, the sealing film 41 is formed of a flexible material having low stiffness, and one surface of the manifold portion 31 is sealed by the sealing film 41. The fixing plate 42 is formed of a relatively hard material. Since the region of the fixing plate 42 which faces the manifold 100 forms an opening portion 43 that is fully removed in the thickness direction, the one surface of the manifold 100 is sealed only by the flexible sealing film 41.

In the recording head 1 of the present embodiment, after taking in the ink from the ink cartridge 2 which is illustrated in FIG. 1 and filling the inner portion from the manifold 100 to the nozzles 21 with the ink, a voltage is applied between each pair of the first electrode 60 and the second electrode 80 which corresponds to the pressure generation chamber 12 according to drive signals from the drive circuit 120, and the vibration plate 50 and the piezoelectric actuator 300 are flexurally warped, thereby increasing the pressure in each of the pressure generation chambers 12 and discharging ink droplets from the nozzles 21.

Figure 4:
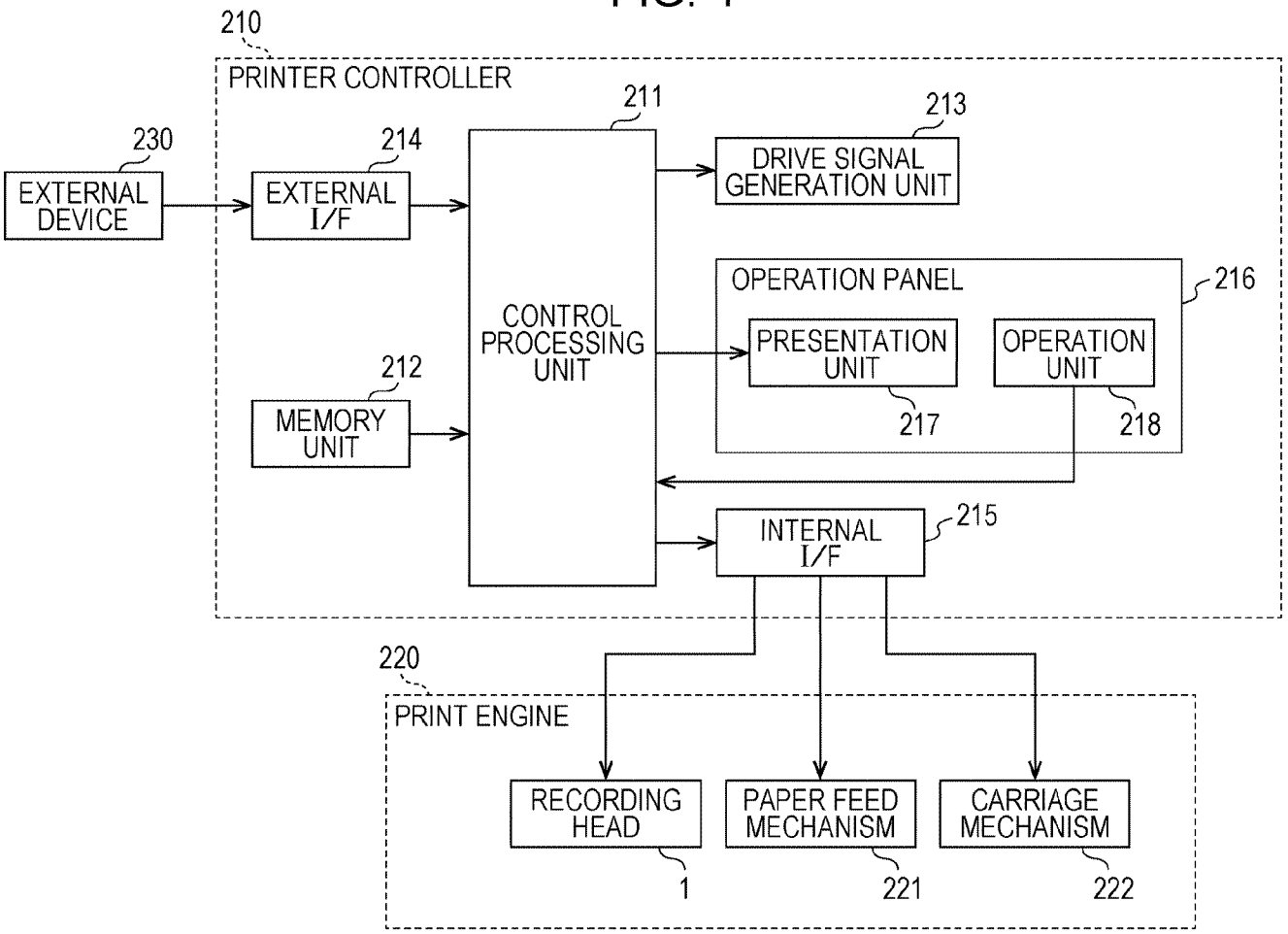
FIG. 4 is a block diagram illustrating the electrical configuration of the recording apparatus according to the first embodiment.

As illustrated in FIG. 1, an ink jet recording apparatus I is provided with a control device 200. Here, the electrical configuration of the present embodiment will be described with reference to FIG. 4. FIG. 4 is a block diagram illustrating the electrical configuration of the ink jet recording apparatus according to the first embodiment of the invention.

As illustrated in FIG. 4, the ink jet recording apparatus I is provided with a printer controller 210 which is the control unit of the present embodiment, and a print engine 220.

The printer controller 210 is an element which performs the overall control of the ink jet recording apparatus I, and in the present embodiment, is provided inside the control device 200 which is provided in the ink jet recording apparatus I.

The printer controller 210 includes a control processing unit 211 which is configured to include a CPU and the like, a memory unit 212, a drive signal generation unit 213, an external I/F (interface) 214, an internal I/F 215, and an operation panel 216.

Print data indicating an image to be printed on the recording sheet S is transmitted from an external device 230 such as a host computer to the external I/F 214, and the print engine 220 is connected to the internal I/F 215. The print engine 220 is an element which records an image on the recording sheet S under the control of the printer controller 210, and includes the recording head 1, the transport roller 8, a paper feed mechanism 221 such as a motor (not illustrated) for driving the same, and a carriage mechanism 222 such as the drive motor 6 and the timing belt 7.

The memory unit 212 includes a ROM which records a control program or the like, and a RAM which temporarily records various data which is necessary for the printing of an image. The control processing unit 211 performs unified control of the elements of the ink jet recording apparatus I by executing the control program which is stored in the memory unit 212. The control processing unit 211 converts the print data which is transmitted from the external device 230 to the external I/F 214 into a head control signal which instructs each of the piezoelectric actuators 300 as to whether to eject or not eject ink droplets from each of the nozzles 21 of the recording head 1 and transmits the result to the recording head 1 via the internal I/F 215. For example, the control processing unit 211 converts the print data into a clock signal CLK, a latch signal LAT, a change signal CH, pixel data SI, setting data SP, and the like. The drive signal generation unit 213 generates the drive signal (COM) and transmits the drive signal (COM) to the recording head 1 via the internal I/F 215. In other words, the head control data and the ejection data such as the drive signal are transmitted to the recording head 1 via the internal I/F 215 which is the transport unit.

The recording head 1 to which the ejection data such as the head control signal and the drive signal is supplied from the printer controller 210 generates an application pulse from the head control signal and the drive signal and applies the application pulse to the piezoelectric actuator 300.

The operation panel 216 is provided with a presentation unit 217 and an operation unit 218. The presentation unit 217 is configured by a liquid crystal display, an organic EL display, and LED lamp, or the like, and presents information and the like for adjusting the drive pulse. The operation unit 218 is configured using various switches and the like.

The control processing unit 211 of the printer controller 210 performs control so as to output, that is, to print a plurality of test patterns which are the image data using different drive signals at predetermined times such as when there is a command from the external device 230 and when there is a command from the operation panel 216. In other words, by executing the control program which is recorded in the memory unit 212, the control processing unit 211 realizes a function of printing a plurality of test patterns using different drive signals. The control program is read from a recording medium such as a floppy disc, a CD ROM, a DVD ROM, or a USB memory which is connected directly via the external I/F 214 or is connected via a host computer. Naturally, the control program may be provided as a printer driver in the host computer. In a case in which the control program is provided in the host computer in this manner, the control unit described in the aspects of the invention is the host computer which is provided with the control program.

The printer controller 210 generates the movement control signal of the paper feed mechanism 221 and the carriage mechanism 222 from the print data which is received from the external device 230 via the external I/F 214, transmits the paper feed mechanism 221 and the carriage mechanism 222 via the internal I/F 215, and performs control of the paper feed mechanism 221 and the carriage mechanism 222.

Here, the printer controller 210 is set so as to generate an optimum drive pulse for stably ejecting ink droplets in accordance with the physical properties of the standard ink in the initial state.

Figure 5:
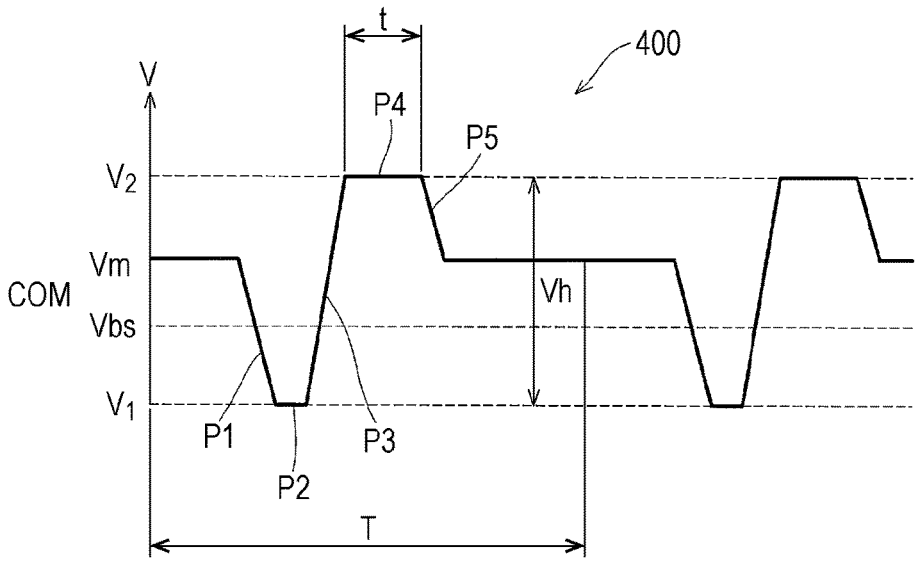
FIG. 5 is a waveform diagram illustrating an example of a drive pulse according to the first embodiment.

Here, description will be given of an example of the drive pulse with reference to FIG. 5. FIG. 5 is a waveform diagram illustrating the drive pulse of the present embodiment.

The drive signal (COM) which is generated by the drive signal generation unit includes a drive pulse which causes an ink droplet to be discharged from the nozzle 21 in one recording period T (frequency 1/T).

As illustrated, the drive pulse is supplied to the second electrode 80 which is the individual electrode using the first electrode 60 which is the common electrode of the piezoelectric actuator 300 as a reference potential (Vbs). In other words, the voltage which is applied to the second electrode 80 by the drive waveform is depicted as a potential which uses the reference potential (Vbs) as a reference.

Specifically, a drive pulse 400 is provided with an expansion element P1, an expansion maintenance element P2, a contraction element P3, a contraction maintenance element P4, and an expansion restoration element P5. The expansion element P1 applies a first potential $V_1$ from a state in which a middle pressure Vm is applied to expand the volume of the pressure generation chamber 12 from a reference volume, the expansion maintenance element P2 maintains the volume of the pressure generation chamber 12 which is expanded by the expansion element P1 for a fixed time, the contraction element P3 applies a potential difference Vh from the first potential $V_1$ to the second potential $V_2$ to contract the volume of the pressure generation chamber 12, the contraction maintenance element P4 maintains the volume of the pressure generation chamber 12 which is contracted by the contraction element P3 for a fixed time, and the expansion restoration element P5 restores the pressure generation chamber 12 from the contracted state of the second potential $V_2$ to the reference volume of the middle potential Vm.

The period T and the elements P1 to P5 of the drive pulse 400 are set in advance using experiments or the like such that stable printing may be performed in the initial state (at the time of factory shipment). In other words, since the viscosity and the surface tension of the ink vary depending on the ink, the period T and the elements P1 to P5 which are optimized according to the viscosity and the surface tension of the standard ink are set as the drive pulse 400. The standard ink is genuine ink which is managed and manufactured by the manufacturer of the ink jet recording apparatus I for example, and the manufacturer is aware of the characteristics of the genuine ink. As a result, it becomes possible to set the period T and the elements P1 to P5 of the drive pulse 400 to suitable values.

However, in the actual usage state, there is a case in which an ink other than the standard ink is used according to the needs to the user. Incidentally, the ink other than the standard ink is an ink with different components which is manufactured by the same manufacturer as the standard ink, ink which is manufactured by another company, or the like. In a case in which a different ink from the standard ink is used, with the drive signal (the drive pulse) of the initial state, it is not possible to stably discharge the ink with different physical properties as ink droplets, and there is a concern that the density, line width, and the like of the image will become unstable. Therefore, the ink jet recording apparatus I of the present embodiment enables the execution of a drive signal adjustment mode which is capable of adjusting either one or both of the period T and the contraction maintenance element P4 of the drive pulse 400 with respect to the different ink when the different ink from the standard ink is used.

In the present embodiment, in the drive signal adjustment mode, the user is capable of causing the presentation unit 217 to present a screen for adjusting the drive signal and is capable of executing the adjustment by operating the operation unit 218.

Here, when the drive signal adjustment mode for adjusting the drive signal is assumed, the control processing unit 211 controls the drive signal generation unit 213 to generate a reference drive pulse and a adjusting drive pulse. The reference drive pulse is formed using values in which both the period T and the contraction maintenance element P4 are used as references, and the adjusting drive pulse is formed using modification values which are different from the values in which either one or both of the period T and the contraction maintenance element P4 are used as references. The printer controller 210 outputs, that is, prints a plurality of test patterns using the reference drive pulse and the adjusting drive pulse which are generated by the drive signal generation unit 213.

A plurality of types of the adjusting drive pulse are formed according to a plurality of different modification values with respect to the reference values. In other words, in the drive signal adjustment mode, the adjusting drive pulse is formed for each of the plurality of modification value which are modified according to a modification amount (an amplitude) to be modified and a range (a number of waves) to be modified with respect to the values which are references for the reference drive pulse.

Incidentally, since the contraction maintenance element P4 is the time to apply the second potential $V_2$, modifying the value of the contraction maintenance element P4 in the drive signal adjustment mode refers to modifying the time for which the second potential $V_2$ is applied. In other words, modifying the time for which the second potential $V_2$ is applied in the contraction maintenance element P4 is represented by modified time $t'=t+n\times\Delta t$, where the modification amount (the amplitude) is $\Delta t$ and the range (the number of waves) to be modified is n (an integer) with respect to a time t which serves as a reference. For example, assuming that the range n to be modified is ±3, since six modified times t' are formed, six adjusting drive pulses which include the six modified times t' are generated.

Since the period T is the time over which a drive pulse 400 is repeated, changing the period T in the drive signal adjustment mode is represented by modified period $T'=T+m\times\Delta T$, where the modification amount (the amplitude) is $\Delta T$ and the range (the number of waves) to be modified is m (an integer) with respect to a period T which serves as a reference. For example, assuming that the range m to be modified is ±3, since six modified periods T' are formed, six adjusting drive pulses which include the six modified periods T' are generated.

In the drive signal adjustment mode, when adjusting drive pulses in which the values of the contraction maintenance element P4 and the values of the period T are modified as described above are generated in six each, a total of 36 adjusting drive pulses are generated.

Figure 6:
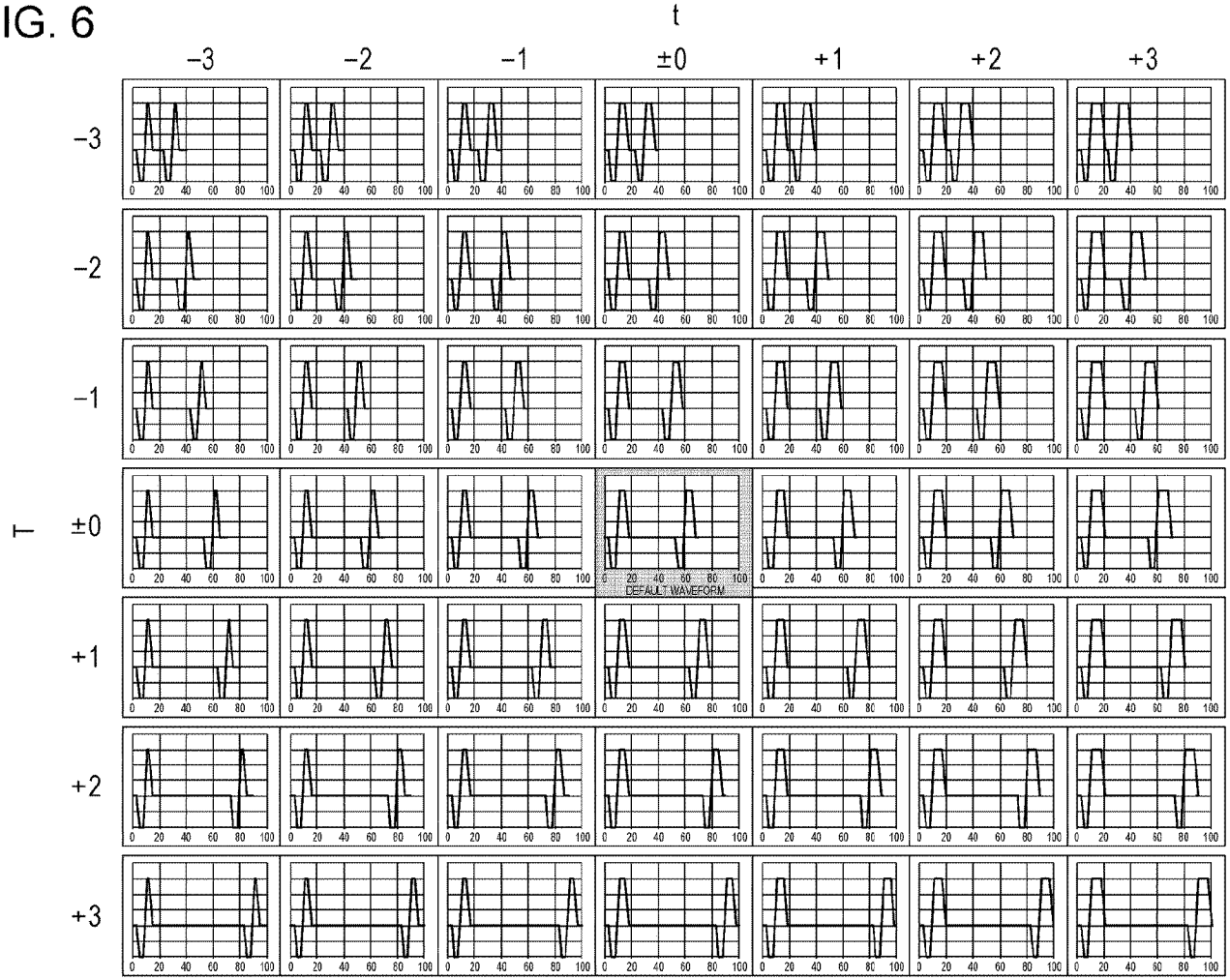
FIG. 6 is a diagram illustrating the disposition of a test pattern and the drive pulse according to the first embodiment.
Figure 7:
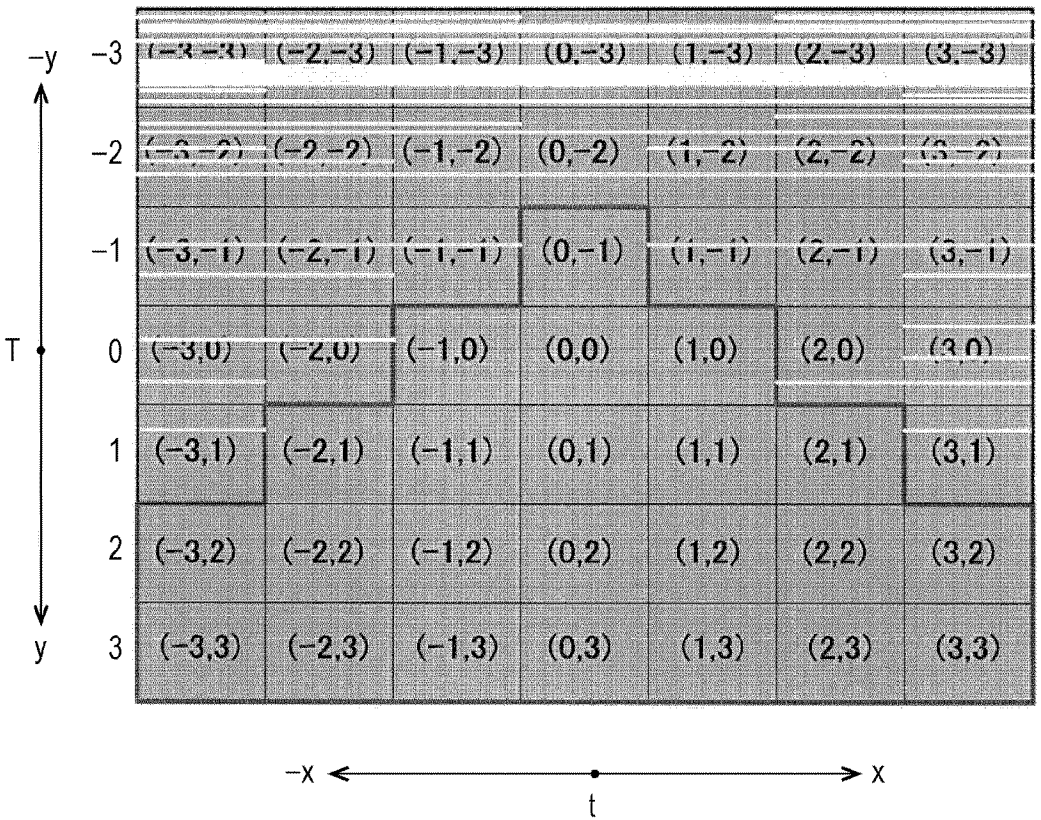
FIG. 7 is a diagram illustrating the printed result of the test pattern according to the first embodiment.

Here, in the drive signal adjustment mode, it is possible to print the plurality of test patterns of the adjusting drive pulses in which the values of the contraction maintenance elements P4 and the values of the period T are modified onto a single recording sheet S in a matrix formation. FIGS. 6 and 7 illustrate the dispositions of the reference drive pulse and the adjusting drive pulses for printing the test patterns, and the printed result. FIG. 6 is a diagram illustrating the dispositions of the reference drive pulse and the adjusting drive pulses when printing the plurality of test patterns in matrix formation, and FIG. 7 is a diagram illustrating the printed result of the test patterns.

As is illustrated in FIG. 6, centered on the test pattern which is printed using the reference drive pulse, the test patterns are printed such that the adjusting drive pulses are disposed in matrix formation, where the adjusting drive pulses are modified such that the horizontal axis is the time t of the contraction maintenance element P4 and the vertical axis is the period T. As a result, as illustrated in FIG. 7, test patterns in which streaks and the like are generated in the test pattern and become printing faults, and test patterns which are stable are formed. In the present embodiment, the position of a test pattern within the recording sheet S is represented by (x, y), where the horizontal axis is a range x to which the time t of the contraction maintenance element P4 is allocated, and the vertical axis is a range y to which the period T is allocated. For example, when the reference drive pulse is set to (0, 0), one to the right side in the horizontal axis x of the reference drive pulse (0, 0) is (1, 0), and one to the left side is (−1, 0). Similarly, in the vertical axis y of the reference pulse (0, 0), one above is (0, −1), and one below is (0, 1). By ascertaining the range x which is allocated the time t of the contraction maintenance element P4, the range y which is allocated the period T, and the positions of the test patterns in relation to each other, when the optimum test pattern for the ink is selected, it is possible to easily ascertain the identification and the setting ranges of the test patterns. In the printed result which is illustrated in FIG. 7, (0, −1), (−1, 0), (1, 0), (−2, 1)~(2, 1), (−3, 2)~(3, 2), and (−3, 3) to (3, 3) among the test patterns result in stable printing in which streaks, density irregularities, and the like do not manifest. In this manner, by disposing the plurality of test patterns in matrix formation to print the test patterns, it is possible to easily compare the plurality of test patterns. In the present embodiment, by lining up the plurality of test patterns in which the time of the contraction maintenance element P4 is modified and lining up the plurality of test patterns in which the period T is modified in the first direction X which is the paper feeding direction while moving the recording head 1 in the second direction Y which is the movement direction in relation to the recording sheet S, compared with lining up the test patterns in which the period is modified in the second direction Y, it is possible to shorten the printing time and it is possible to suppress shifting between the landing positions of the ink droplets in the +Y direction heading from Y1 toward Y2 in the second direction Y and the landing positions of the ink droplets in the −Y direction heading from Y2 toward Y1.

Figure 8:
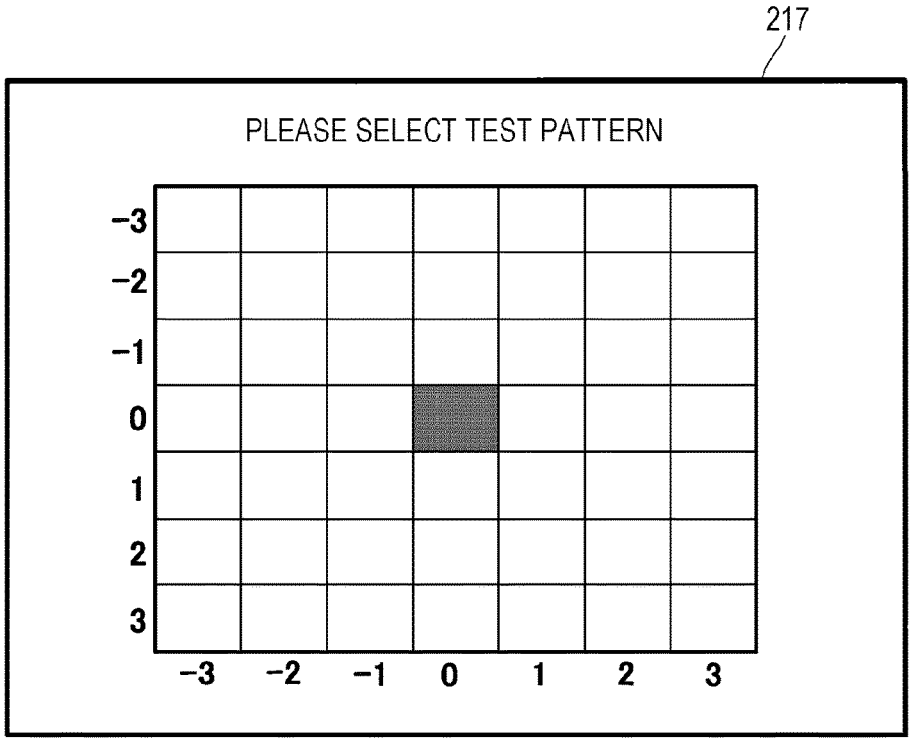
FIG. 8 is a diagram illustrating a selection screen according to the first embodiment.
Figure 9:
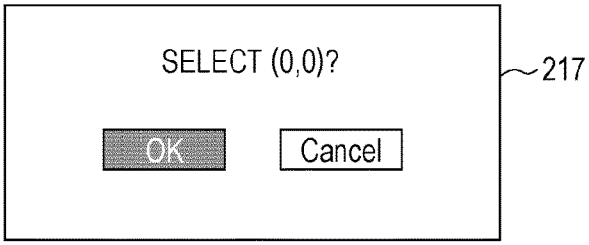
FIG. 9 is a diagram illustrating the selection screen according to the first embodiment.

The user selects the optimum test pattern from the plurality of test patterns. The selected test pattern is input from the operation unit 218 of the operation panel 216, for example. In the present embodiment, as illustrated in FIG. 8, the presentation unit 217 is caused to present a schematic diagram in which the plurality of test patterns are disposed in a matrix formation as blocks, and the test pattern is selected from among the blocks which are displayed on the presentation unit 217 using the operation unit 218 based on the printed result of the test patterns. Once the test pattern is selected from among the blocks which are presented on the presentation unit 217 using the operation unit 218, as illustrated in FIG. 9, a confirmation screen may be presented on the presentation unit 217. In other words, in the confirmation screen illustrated in FIG. 9, it is confirmed as to whether or not there is no problem with the selected test pattern, and if "OK" is selected, the selected test pattern is set. If "Cancel" is selected, the process returns to the screen of FIG. 8 and the test pattern may be reselected. Naturally, the selection screen which is presented on the presentation unit 217 is not limited thereto, and, for example, the position of the selected test pattern may be input using (x, y) as described above.

When the test pattern is selected, the control processing unit 211 stores the set value of the selected test pattern, that is, the time t' of the corrected contraction maintenance element P4 and the corrected period T' in the memory unit 212. The control processing unit 211 stores the time t' and the period T' in the memory unit 212 as offset amounts from the reference time t of the contraction maintenance element P4 and the reference period T. The control processing unit 211 controls the drive signal generation unit 213 such that the drive pulses which are generated during the printing outside of the test patterns become the adjusting drive pulses of the time t' of the corrected contraction maintenance element P4 and the corrected period T'.

In the ink jet recording apparatus I of the present embodiment, since four colors of ink are ejected, in the drive signal adjustment mode, a plurality of test patterns are printed for each color, and a test pattern with which the printing is stable in all colors is selected. In other words, in the present embodiment, all of the piezoelectric actuators 300 are driven using the same drive signal without changing the drive signal to be applied to the piezoelectric actuators 300 for each color of the ink. Therefore, a plurality of test patterns are printed for each color of the ink, and a test pattern which is optimum for all colors is selected. Here, such an example is illustrated in FIGS. 10 to 29. FIGS. 10 to 13 are the test patterns of each color of a case in which the standard inks for which the initial state is anticipated are used, and illustrate portions at which a filled portion is stably printed. FIG. 14 is a diagram illustrating the combination of the results of the test patterns of each color, that is, illustrating the positions at which test patterns in which stable printing is performed overlap. FIGS. 15 to 18 are test patterns of each of the colors in the case of using company A product inks A1, and FIG. 19 is a diagram illustrating the result of combining the test patterns of the company A product inks A1. FIGS. 20 to 23 are test patterns of each of the colors in the case of using company B product inks B1, and FIG. 24 is a diagram illustrating the result of combining the test patterns of the company B product inks B1. FIGS. 25 to 28 are test patterns of each of the colors in the case of using company C product inks C1, and FIG. 29 is a diagram illustrating the result of combining the test patterns of the company C product inks C1.

As illustrated in FIGS. 10 to 13, when the test patterns in which stable printing is performed in the test patterns of each of the colors which use the standard inks are combined, as illustrated in FIG. 14, the period T is shortest, that is, it is possible to quickly perform the printing using the test pattern (0, 0) for all of the colors. Therefore, in the initial state which uses the standard inks, the reference drive pulse is set in which the time t of the contraction maintenance element P4 and the period T of the test pattern (0, 0) are set as the reference values.

In contrast, as illustrated in FIGS. 15 to 18, when the test patterns in which stable printing is performed in the test patterns of each of the colors which use the company A product inks A1 are combined, as illustrated in FIG. 19, the period T is shortest, that is, it is possible to quickly perform the printing using the test pattern (2, 0) for all of the colors. Therefore, in a case in which the company A product inks A1 are used, by using the adjusting drive pulse from when the test pattern (2, 0) is printed during the printing, it is possible to realize stabilized printing in all of the colors of the company A product inks A1.

Similarly, as illustrated in FIGS. 20 to 23, when the test patterns in which stable printing is performed in the test patterns of each of the colors which use the company B product inks B1 are combined, as illustrated in FIG. 24, the period T is shortest, that is, it is possible to quickly perform the printing using the test pattern (0, −3) for all of the colors. Therefore, in a case in which the company B product inks B1 are used, by using the adjusting drive pulse from when the test pattern (0, −3) is printed during the printing, it is possible to realize stabilized printing in all of the colors of the company B product inks B1.

Similarly, as illustrated in FIGS. 25 to 28, when the test patterns in which stable printing is performed in the test patterns of each of the colors which use the company C product inks C1 are combined, as illustrated in FIG. 29, the period T is shortest, that is, it is possible to quickly perform the printing using the test pattern (1, 1) and (2, 1) for all of the colors. Either of the test pattern (1, 1) and (2, 1) may be selected; however, it is preferable to select the test pattern which is closest to the reference test pattern (0, 0). Therefore, by using the adjusting drive pulse from when the test pattern (1, 1) is printed during the printing, it is possible to realize stabilized printing in all of the colors of the company C product inks C1.

Figure 30:
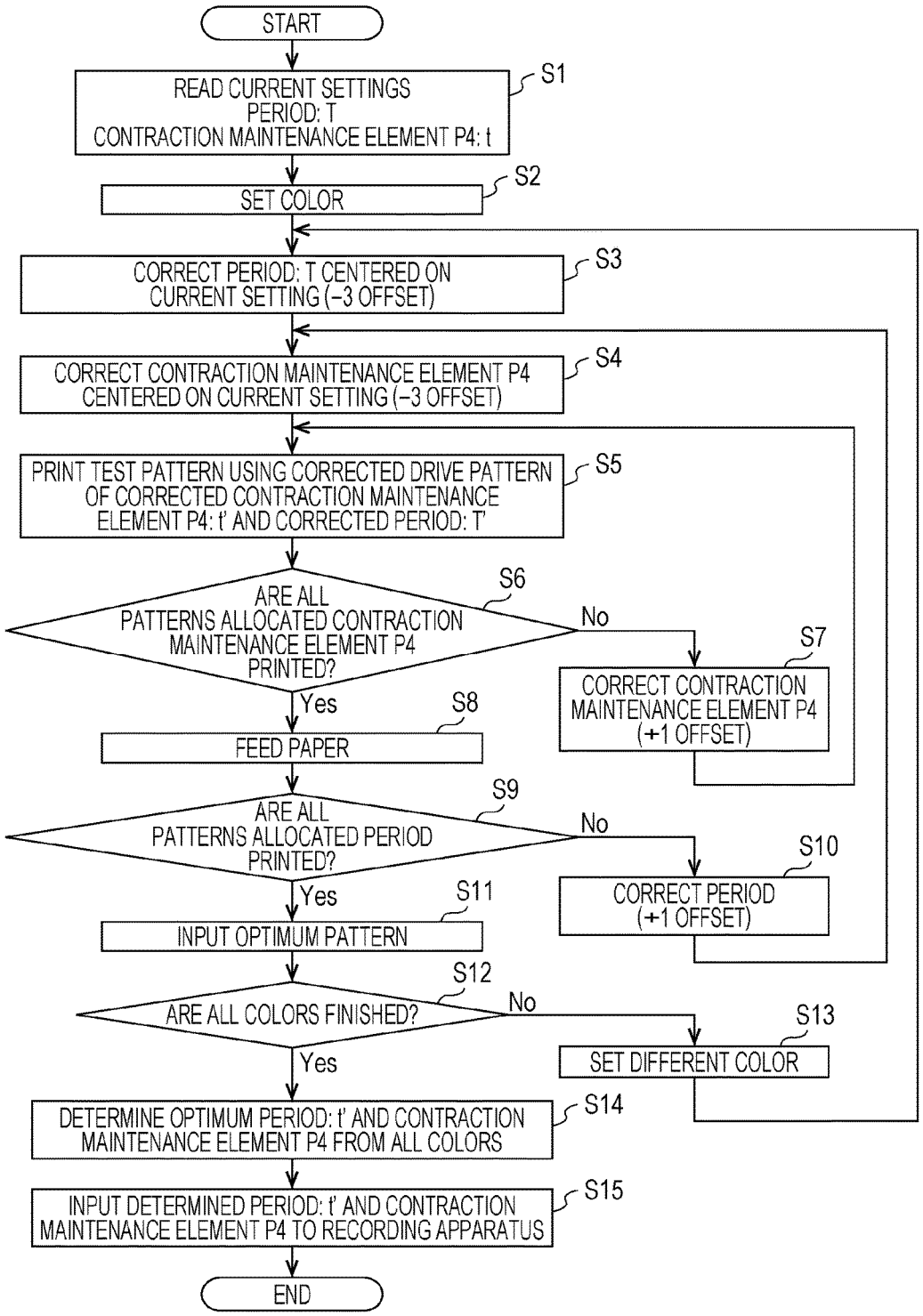
FIG. 30 is a flowchart illustrating a drive signal adjustment method according to the first embodiment.

Here, description is given of the drive signal adjustment method of the liquid ejecting head with reference to FIG. 30. FIG. 30 is a flowchart illustrating the drive signal adjustment method.

As illustrated in FIG. 30, when the drive signal adjustment mode is assumed in step S1, the initial values of the period T and the time t of the contraction maintenance element P4 of the drive pulse are read. Next, in step S2, one of the colors to be printed, in the present embodiment, cyan (C), magenta (M), yellow (Y) and black (K) is selected. Next, in step S3, the value of the period T is corrected based on the modification amount and the range to be modified, centering on the current setting. In the present embodiment, for example, the period T is first offset to −3. Next, in step S4, the time t of the contraction maintenance element P4 is corrected based on the modification amount and the range to be modified. In the present embodiment, the time t of the contraction maintenance element P4 is first offset to −3. The adjusting drive pulse is generated based on the period T' which is corrected in step S5 and the corrected time t' of the contraction maintenance element P4, and the test pattern is printed using the adjusting drive pulse.

Next, in step S6, it is determined whether all of the test patterns are printed in the range over which to modify the contraction maintenance element P4. In step S6, if it is determined that not all of the test patterns in the range over which to modify the contraction maintenance element P4 are printed (step S6; No), in step S7, the time t' of the contraction maintenance element P4 is corrected based on the modification amount and the range to be modified. In the present embodiment, correction is performed in which the corrected time t' (t−3) of the contraction maintenance element P4 is further offset by +1. In other words, the time t' is offset by −2 with respect to the reference time t. A plurality of test patterns which are allocated the times of the contraction maintenance elements P4 in the period T' which is corrected by repeatedly performing step S5 to step S7 are printed. In step S5 to step S7, since the plurality of test patterns are printed without paper feeding the recording sheet S, the plurality of test patterns are provided to line up in the second direction Y which is the movement direction of the carriage 3.

If it is determined in step S6 that all the test patterns in the range over which to modify the contraction maintenance element P4 are printed (step S6; Yes), the recording sheet S is transported by the transport unit in step S8. Next, in step S9, it is determined whether all of the patterns which are allocated periods are printed, and in step S9, in a case in which it is determined that the patterns which are allocated periods are not all printed (step S9; No), in step S10, the period T' is corrected based on the modification amount and the range to be modified. In the present embodiment, correction is performed in which the corrected period T' (T−3) is further offset by +1. In other words, the period T' is offset by −2 (T−2) with respect to the reference period T. Subsequently, by repeatedly performing steps S5 to S10, all of the test patterns which are allocated the times t' (t±3) of the contraction maintenance element P4 in each of the corrected periods T' (T±3) are printed.

In step S9, in a case in which it is determined that the test patterns which are allocated the periods are all printed (step S9; Yes), in step S11, the optimum period T' and time t' are input from the optimum test pattern. Next, in step S12, it is determined whether the period T' and the time t' which are optimum are input for all of the colors, and if it is determined that the period T' and the time t' which are optimum are not input for all of the colors (step S12: No), in step S13, a different color is set, and step S3 to step S12 are performed again. In other words, all of the test patterns are printed in which the values which are allocated the period T and the values which are allocated the time t of the contraction maintenance element P4 are combined with respect to all of the colors according to step S1 to step S12.

Next, in step S12, if it is determined that the optimum period T' and time t' are input for all of the colors (step S12; Yes), in step S14, the optimum period T' and time t' of the contraction maintenance element P4 are determined from all of the colors. In step S15, the optimum period T' and time t' of the contraction maintenance element P4 for all of the colors are stored in the ink jet recording apparatus I.

As described hereinabove, in the drive signal adjustment method of the present embodiment, by printing the plurality of test patterns using the adjusting drive pulse which is corrected to the period T' and the time t' of the contraction maintenance element P4 with respect to the reference period T and time t of the contraction maintenance element P4, it is possible to set the period and the time of the contraction maintenance element P4 which are optimum for the ink. Therefore, when the type of the ink such as another company product ink is changed in relation to the standard ink, by discharging which is suitable for the ink is performed by performing the drive signal adjustment method, and it is possible to improve the print quality.

Since all that is performed is that a plurality of test patterns are printed and the optimum values are set, a user of the ink jet recording apparatus I is capable of easily performing the drive signal adjustment method at an arbitrary timing.

The drive signal adjustment mode in which the above-described drive signal adjustment method is performed may be performed by the user operating the operation unit 218 at an arbitrary timing.

Other Embodiments

Hereinabove, an embodiment of the invention is described; however, the basic configuration of the invention is not limited to the configuration which is described above.

Figure 31:
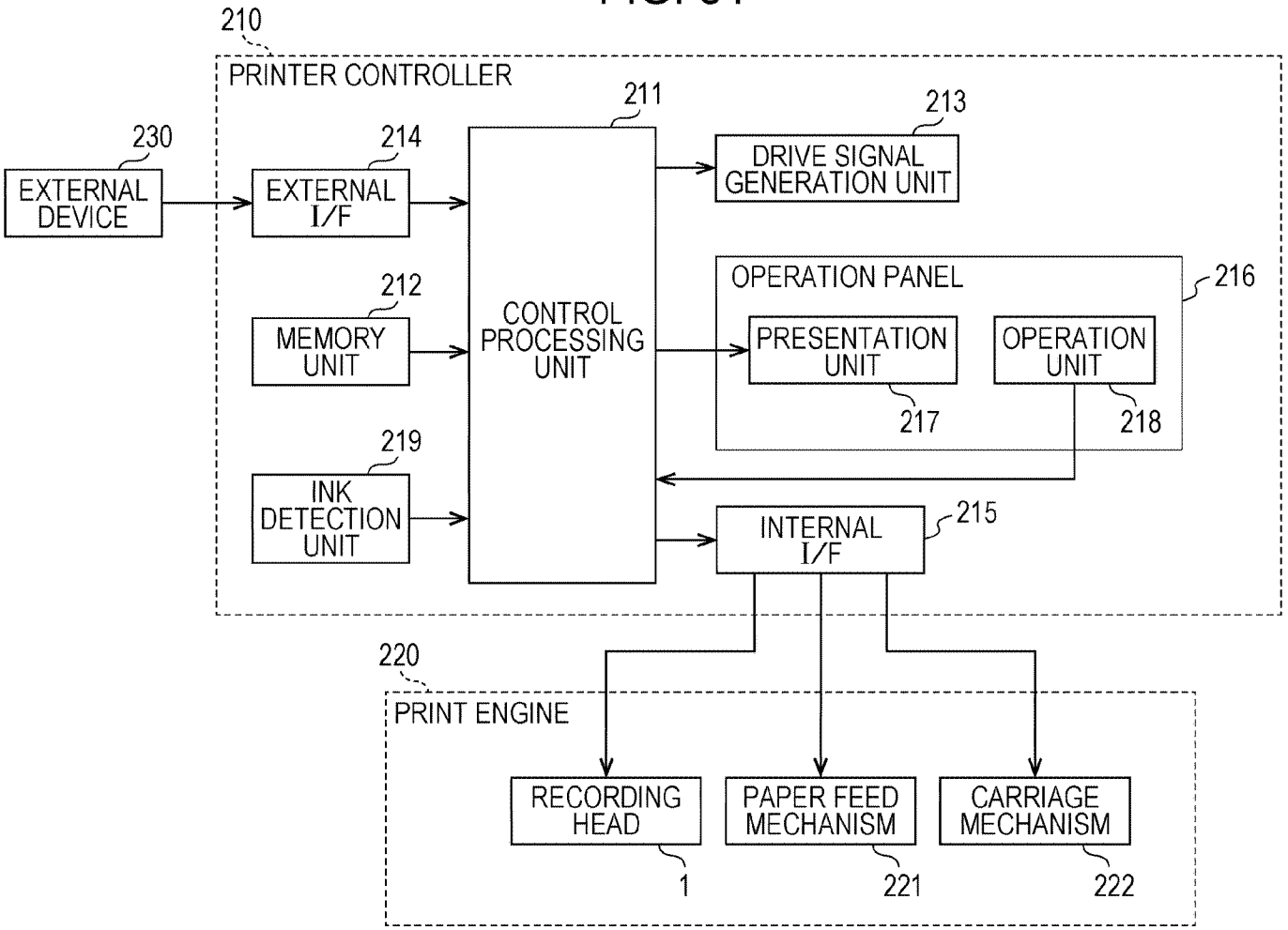
FIG. 31 is a block diagram illustrating the electrical configuration of the recording apparatus according to another embodiment.

For example, in the embodiment which is described above, the drive signal adjustment is started by the user selecting the drive signal adjustment mode of the ink jet recording apparatus I; however, the invention is not particularly limited thereto, and the adjustment of the drive signal may be started in a case in which the ink jet recording apparatus I detects a predetermined situation. In the present embodiment, as illustrated in FIG. 31, the ink jet recording apparatus I includes an ink detection unit 219.

When the fact that an ink other than the standard ink is used is detected by the ink detection unit 219, the control processing unit 211 may start the adjustment of the drive signal. In other words, the control processing unit 211 may present a selection screen of whether or not to carry out the drive signal adjustment mode on the presentation unit 217.

For example, an identification unit such as a two-dimensional code such as a bar-code or a QR code (registered trademark), or an IC chip may be installed in the ink cartridge 2 in advance, and based on the information which is read from the identification unit by the ink detection unit 219, the fact that an ink other than the standard ink is being used may be detected.

There is also a case in which it is possible to read the ink remaining amount in the ink cartridge 2 from the identification unit such as the IC chip of the ink cartridge 2. In this case, when the ink detection unit 219 detects replacement or addition of ink based on the ink remaining amount which is read from the identification unit such as the IC chip, the adjustment of the drive signal may be started.

For example, as described above in the first embodiment, after printing a plurality of test patterns using the drive signal adjustment method, a selection screen for selecting the modification amount and the range to modify of the value of the contraction maintenance element P4 is displayed on the presentation unit 217, and based on the result which is selected by the user from the selection screen, the modification amount and the range to modify of the value of the contraction maintenance element P4 may be changed. Here, an example of the selection screen will be illustrated in FIG. 32.

Figure 32:
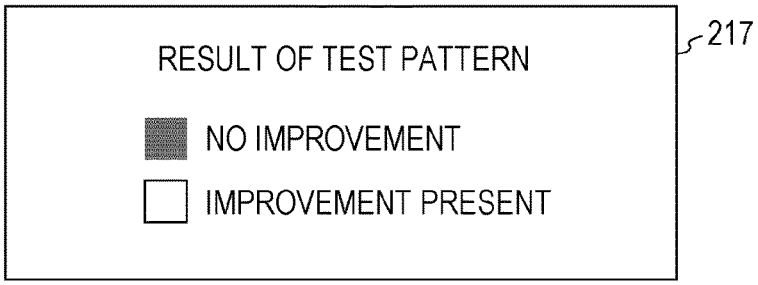
FIG. 32 is a diagram illustrating a selection screen according to another embodiment.

As illustrated in FIG. 32, a state in which it is possible to select one of "no improvement" and "improvement present" is displayed on the presentation unit 217 as the selection screen. The selection "no improvement" is selected in a case in which there are no or few test patterns which are stably printed. When "no improvement" is selected using the operation unit 218, either one or both of the modification amount and the range to modify of the contraction maintenance element P4 are increased, and the plurality of test patterns are printed again. In other words, in a case in which "no improvement" is selected, amendment is performed such that the contraction maintenance element P4 assumes values which are further distanced from the reference value than in the first test patterns such that a stable test pattern is printed. Accordingly, it is possible to ensure that a stable test pattern is printed, and to set the value of the case in which the stable test pattern is printed.

Figure 33:
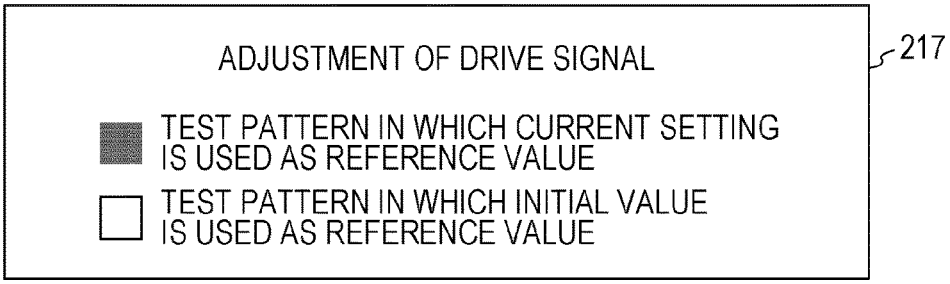
FIG. 33 is a diagram illustrating a selection screen according to another embodiment.

In a case in which "improvement present" is selected, the drive signal adjustment mode may be finished; however, in order to realize further stabilized printing, either one or both of the modification amount and the range to modify during the printing of the first test pattern is reduced, and the plurality of test patterns are printed again. Accordingly, it is possible to set the value of the stable printing in more detail. Naturally, the same applies to the period, and the modification amount and range to modify of the period may be increased or decreased depending on whether "improvement present" or "no improvement" is selected, and the plurality of test patterns may be printed again. After the period and the contraction maintenance element P4 are set using the drive signal adjustment method, in a case in which the adjustment of the drive signal is carried out by further modifying the ink, as illustrated in FIG. 33, a selectable presentation is performed on the presentation unit 217 as to whether to print a plurality of test patterns which are corrected using the values of the period of the standard ink and the contraction maintenance element P4 as reference values, or to print a plurality of test patterns which are corrected using the current settings as the reference values to allow the user to make a selection. Incidentally, in a case in which the components of the ink are similar before and after the exchanging, it is possible to specify a stable test pattern in a shorter time by performing the correction using the current settings as the reference values. Incidentally, examples of the components of the ink include pigment ink and dye ink.

Figures 34, 35:
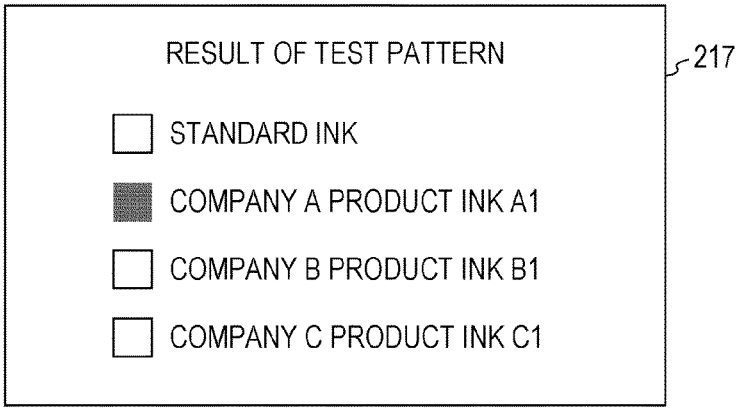
FIG. 34 is a diagram illustrating a correction information table according to another embodiment.
FIG. 35 is a diagram illustrating a selection screen according to another embodiment.

In a case in which it is possible to investigate in advance the period and the contraction maintenance element P4 which are suitable for the physical properties of the ink experimentally or the like for each different type of ink, the type of the ink and the correction values with respect to the reference values of the period and the contraction maintenance element P4 corresponding to the type of ink are stored in advance in a correction information table such as the one illustrated in FIG. 34. By presenting the selection screen of the inks as illustrated in FIG. 35 on the presentation unit 217 and allowing the user to make a selection, the corrected values with respect to the reference values of the period and the contraction maintenance element P4 may be set based on the correction information table. The reference drive pulse may be generated using the corrected period and contraction maintenance element P4 as reference values based on the correction information table, and the plurality of test patterns may be printed using the adjusting drive pulse in which the period and the contraction maintenance element P4 are modified with respect to the reference drive pulse.

Past setting values of the contraction maintenance element P4 and the period of the drive pulse may be stored, and the setting values may be restored at a desired timing. Accordingly, it is possible to restore arbitrary setting values when incorrect settings are performed or the like.

Since the viscosity of the ink varies with temperature change, the printer controller 210 may further be provided with a function of correcting the drive pulse such that the drive pulse is optimized corresponding to the temperature change of the ink.

In the first embodiment which is described above, the time of the contraction maintenance element P4 and the period T are modified; however, the invention is not limited thereto, and either one of the contraction maintenance element P4 and the period T only may be modified. In addition to modifying either one or both of the contraction maintenance element P4 and the period T, the potential difference Vh may be modified. In other words, a plurality of test patterns in which the potential difference Vh is modified for the modification amount (the amplitude) and the range to modify (the number of waves) are printed, and it is possible to further improve the stability of the printing. Naturally, test patterns in which other components, for example, the value of the expansion element P1, the value of the expansion maintenance element P2, the value of the contraction element P3, the value of the expansion restoration element P5, and the like are further modified may be printed to further improve the stability of the printing.

In the first embodiment which is described above, a selection screen with which it is possible to select a specific test pattern from a plurality of test patterns is displayed on the presentation unit 217; however, the invention is not particularly limited thereto, and a plurality of test patterns may be read using a scanner, and a specific test pattern may be selected using image processing.

Furthermore, in the first embodiment which is described above, a configuration is exemplified in which the carriage 3 moves relative to the recording sheet S in the second direction Y; however, the invention is not particularly limited thereto, and it is possible to apply the invention to a so-called line recording apparatus which performs the printing merely by the recording head 1 being fixed to the apparatus main body 4 and by moving the recording sheet S in the first direction X.

In the embodiments which are described above, a configuration in which the printer controller 210 realizes the function of adjusting the drive signal is exemplified; however, the invention is not limited thereto. For example, in the external device 230 such as the host computer, a control program which realizes the function of adjusting the drive signal may be read and executed from a recording medium in which the control program is stored. In other words, it is possible to adopt a configuration which adjusts the drive signal such as a printer driver of the external device 230. In this case, the external device 230 becomes the control unit which realizes the function of adjusting the drive signal.

In the first embodiment which is described above, the piezoelectric actuator 300 of a thin film type is used as the pressure generation unit that generates a pressure change in the pressure generation chamber 12; however, the invention is not particularly limited thereto, for example, a configuration may be adopted which uses a piezoelectric actuator of a thick film type, which is formed using a method such as bonding green sheets, a piezoelectric actuator of a longitudinal vibrating type in which a piezoelectric material and an electrode forming material are alternately laminated and caused to expand and contract in an axial direction, and the like. As the pressure generation unit, it is possible to use a unit in which a heating element is disposed within a pressure generation chamber and droplets are discharged from a nozzle opening due to a bubble which is generated by the heating of the heating element. It is also possible to use a so-called electrostatic actuator which generates static electricity between the vibration plate and an electrode and causes droplets to be discharged from a nozzle opening by causing the vibration plate to deform using an electrostatic force.

In the example which is described above, the ink jet recording apparatus I is configured such that the ink cartridge 2, which is the liquid storage unit, is installed on the carriage 3; however, the invention is not limited thereto, for example, the liquid storage unit such as an ink tank may be fixed to the apparatus main body 4, and the liquid storage unit and the recording head 1 may be connected to one another via a supply tube such as a tube. The liquid storage unit may also not be installed on the ink jet recording apparatus.

Furthermore, the invention widely targets liquid ejecting apparatuses which are provided with liquid ejecting heads in general. For example, it is possible to use the invention in liquid ejecting apparatuses which use recording heads such as a variety of ink jet recording heads that are used in an image recording apparatus such as a printer, a color material ejecting head, which is used in the manufacture of color filters of liquid crystal displays and the like, an electrode material ejecting head, which is used in the electrode formation of organic EL displays, field emission displays (FED) and the like, and a biological organic matter ejecting head, which is used in the manufacture of biochips.

The entire disclosure of Japanese Patent Application No. 2016-142814, filed Jul. 20, 2016 is expressly incorporated by reference herein.

What is claimed is:

1. A method for adjusting a drive signal of a liquid ejecting head, wherein the drive signal which includes a drive pulse that is supplied to a drive element of the liquid ejecting head, which includes a nozzle, a pressure generation chamber that communicates with the nozzle, and the drive element, wherein the drive element generates a pressure change in a liquid inside the pressure generation chamber, wherein the drive pulse includes:

an expansion element which expands a volume of the pressure generation chamber from a reference volume, an expansion maintenance element which maintains the volume of the pressure generation chamber which is expanded by the expansion element, a contraction element which contracts the volume of the pressure generation chamber, a contraction maintenance element which maintains the volume of the pressure generation chamber which is contracted by the contraction element, and an expansion restoration element which restores the volume of the pressure generation chamber to the reference volume, the method comprising:

printing a plurality of test patterns which are image data using an adjusting drive pulse which includes modification values in which either one or both of a time of the contraction maintenance element and a period of the drive pulse are modified, and setting the adjusting drive pulse including the modification values corresponding to a specific test pattern that is selected from among the plurality of test patterns as the drive pulse to be supplied to the drive element at a time of printing.

2. The method according to claim 1, wherein the test patterns includes the test patterns printed by using the adjusting drive pulses having the modification values in which at least a time of the contraction maintenance element are modified, and the method comprising:

displaying a selection screen for selecting a modification amount and a range to modify of the time of the contraction maintenance element, setting the modification values in which a time of the contraction maintenance element is modified based on the modification amount and the range to modify which are selected from the selection screen.

3. The method according to claim 1, wherein the plurality of test patterns are disposed in a matrix formation and output onto a medium using a drive pulse which includes the modification values in which both the time of the contraction maintenance element and the period are modified.

4. The method according to claim 3, wherein the plurality of test patterns in which the times of the contraction maintenance elements are different are provided to line up in a movement direction with respect to the medium of the liquid ejecting head, and wherein the plurality of test patterns which have different periods of the drive pulse are provided to line up in a direction which is orthogonal to the movement direction which is a transport direction of the medium.

5. The method according to claim 1, wherein after a specific one of the test patterns is selected, a modification amount and a range to modify of the modification value of the drive pulse are further specified and a plurality of test patterns are output.

6. The method according to claim 1, wherein the modification value which is previously set is stored, and the modification value may be restored.

7. The method according to claim 1, wherein by selecting the liquid, the modification value, in which either one or both of a time of a contraction maintenance element and a period of the drive pulse which is associated with the liquid is set in advance, is acquired, a value is modified from the modification value which is acquired, and the plurality of test patterns are output.

8. The method according to claim 1, wherein when it is detected that the liquid is exchanged or added to, the plurality of test patterns are output to allow a specific test pattern to be selected.

9. A liquid ejecting apparatus comprising:

a nozzle that ejects a liquid;

a pressure generation chamber that communicates with the nozzle;

a drive element that generates a pressure change in a liquid inside the pressure generation chamber due to a drive signal being applied;

a drive signal generation unit that as the drive signal, a drive signal which that includes a drive pulse, wherein drive pulse includes:

an expansion element which expands a volume of the pressure generation chamber from a reference volume, an expansion maintenance element which maintains the volume of the pressure generation chamber which is expanded by the expansion element, a contraction element which contracts the volume of the pressure generation chamber, a contraction maintenance element which maintains the volume of the pressure generation chamber which is contracted by the contraction element, and an expansion restoration element which restores the volume of the pressure generation chamber to the reference volume;

a control unit that controls the drive signal generation unit to generate a reference drive pulse which is the drive pulse which is generated using reference values in which a time of the contraction maintenance element and a period of the drive pulse are references, and an adjusting drive pulse which is the drive pulse which is generated using modification values in which the time of the contraction maintenance element and the period are different from the reference values, and drives the drive element using each of the reference drive pulse and the adjusting drive pulse which are generated to output a plurality of test patterns; and a presentation unit which presents a specific test pattern from the plurality of test patterns in a selectable manner, wherein the control unit sets the modification values which are used for the output of the specific test pattern based on the specific test pattern which is selected on the presentation unit.

* * * * *